US006109298A

United States Patent [19]

Kaneko et al.

[11] Patent Number: 6,109,298

[45] Date of Patent: Aug. 29, 2000

[54] SEALED TRANSFER VALVE ASSEMBLY

[75] Inventors: Ryushiro Kaneko; Makoto Ishikawa; Masaru Narita, all of Yawara-mura, Japan

[73] Assignee: SMC Corporation, Tokyo, Japan

[21] Appl. No.: 09/028,647

[22] Filed: Feb. 24, 1998

[30] Foreign Application Priority Data

Mar. 14, 1997 [JP] Japan ..... 9-081982

[51] Int. Cl.[7] ..... F16K 37/00; F15B 13/043

[52] U.S. Cl. ..... 137/551; 137/560; 137/625.64; 137/884

[58] Field of Search ..... 137/551, 560, 137/270, 271, 596.16, 596.2, 625.64, 884

[56] References Cited

U.S. PATENT DOCUMENTS

| | | | |
|---|---|---|---|
| 3,111,149 | 11/1963 | Schubert . | |
| 3,550,621 | 12/1970 | Lanksy et al. | 137/884 |
| 4,938,258 | 7/1990 | Sato | 137/560 X |
| 5,333,647 | 8/1994 | Fukano et al. | 137/884 |
| 5,437,306 | 8/1995 | Asou et al. | 137/625.64 |
| 5,459,953 | 10/1995 | Fukano et al. | 137/625.64 |
| 5,558,122 | 9/1996 | Kawamura et al. | 137/625.64 X |
| 5,558,126 | 9/1996 | Hayashi et al. | 137/625.64 |
| 5,597,015 | 1/1997 | Asou et al. | 137/884 X |
| 5,664,604 | 9/1997 | Sato et al. | 137/884 |

FOREIGN PATENT DOCUMENTS

| | | |
|---|---|---|
| 0 719 949 | 7/1996 | European Pat. Off. . |
| 43 05 608 | 8/1994 | Germany . |
| 43 36 208 | 4/1995 | Germany . |
| 2 131 631 | 6/1984 | United Kingdom . |

*Primary Examiner*—John Rivell
*Attorney, Agent, or Firm*—Oblon, Spivak, McClelland, Maier & Neustadt, P.C.

[57] ABSTRACT

A sealing article 17 is provided in the opening edge of a depression 2*c* provided in a manifold 2 to connect a supply connector 16 and a receiving connector 44 in an air-tight manner. A solenoid section 33, in which a solenoid 31 in each of pilot valve 21*a* and 21*b* and a receiving connector 44 that supplies power to connector 31 are sealed into a synthetic resin 45, is provided in a transfer valve 3A. Solenoid section 33 has a lamp circuit board 49 mounted on its outer surface to receive power from receiving connector 44, and includes power supply indicator lamps 48; and a cover 50, covering the whole of lamp circuit board 49, mounted to form an air-tight seal on its outer surface via a gasket 52.

12 Claims, 5 Drawing Sheets

20
21a
21b
22
23
24
24a
24b
25
27a
27b
28a
28b
29a
29b
37
42
43
43a
44
46
49
50
64
65
66
66b
67a
67b
EA
A
P
B
EB
1
2
3A
2a
2b
2c
5
6
6A
6B
7
8
9A
9B
10A
10a
10B
11
12
14
15
16
17

SEALED TRANSFER VALVE ASSEMBLY

FIELD OF THE INVENTION

The present invention relates to a sealed transfer valve assembly that provides improved insulating capabilities by creating an air-tight seal of electrical connections.

PRIOR ART

Commonly-used techniques provide for a transfer valve assembly that couples a solenoid-operated pilot transfer valve, in which a solenoid-operated pilot valve operates a main valve for switching channels for an operating fluid, to a manifold for supplying operating fluid and power to the transfer valve.

In such a transfer valve assembly, when an electrical connection that supplies power to the solenoid in a pilot valve, or a mounting portion for electrical parts such as power supply indicator lamps, is left exposed, its insulating capabilities may deteriorate if the transfer valve operates in a humid environment, resulting in leakage or open circuits. Such deterioration leads to hazardous conditions.

As one example of efforts to find a solution to this difficulty, Japanese Patent Application Laid Open No. 4-272583 discloses a transfer valve assembly in which the connection between a supply connector in the manifold and a receiving connector in the transfer valve is sealed by an air-tight sealing article. However, the method used by this invention to provide an air-tight seal calls for pressing the tip of a housing for the receiving connector against a gasket. The seal thus created is subject to deterioration if any looseness exists in the mounting of the transfer valve to the manifold. In addition, to provide air-tight connections, mounting power supply indicator lamps or related electrical parts on the transfer valve requires a simple method not requiring lead connections.

DISCLOSURE OF THE INVENTION

It is a technical object of this invention to specify a transfer valve assembly configured by mounting a solenoid-operated pilot transfer valve on a manifold, producing an assembly with improved insulating capabilities, using a simple method to form air-tight seals of the connection between the transfer valve and manifold and the mounting portion for electrical parts, such as power supply indicator lamps.

To achieve this object, a transfer valve assembly according to this invention is characterized in that a sealing article is formed between a supply connector provided in a manifold and a receiving connector provided in a transfer valve, in order to connect the connectors in an air-tight manner, and in that the transfer valve includes a solenoid section in which a the solenoid in each pilot valve and the receiving connector supplying power to the solenoid are sealed in synthetic resin, the solenoid section including a lamp circuit board mounted on its outer surface to receive power from the receiving connector and having power supply indicator lamps. The number of these power supply indicator lamps match the number of pilot lamps; and the solenoid section also includes an air-tight cover mounted on its outer surface via a sealing article that covers the overall circuit board.

According to this invention, the electrical connection between the transfer valve and the manifold and the mounting portion for electrical parts such as power supply indicator lamps are reliably sealed, improving insulating capabilities.

According to a specific example, the receiving connector in the transfer valve has a cylindrical housing and a number of pin-like receiving terminals; the receiving connector in the manifold has a number of supply terminals placed in a depression in which the housing is fitted, so that the supply terminals contact the receiving terminals; and the sealing article provided at the opening edge of the depression forms an air-tight seal against the outer surface of the solenoid section and the outer circumferential surface of the housing.

This configuration allows increased reliability in the seal of the connection between supply and receiving connectors, compared to conventional transfer valves. According to another specific example of this invention, the rear end of each receiving terminal projects toward the rear surface of the solenoid section, the lamp circuit board having connection holes in which the receiving terminals are fitted. This example of the invention also has printed wiring that connect the receiving terminals and lamps.

According to one embodiment of this invention, the transfer valve is of a double-pilot type, having two pilot valves and two solenoids in the two pilot valves, integrally sealed in the solenoid section of the transfer valve.

According to another embodiment of this invention, the transfer valve is of a single-pilot type, having one pilot valve and one solenoid and one dummy member having substantially the same shape and size as the solenoid, integrally sealed in the solenoid section of the transfer valve.

EMBODIMENTS OF THE INVENTION

Figure 1:
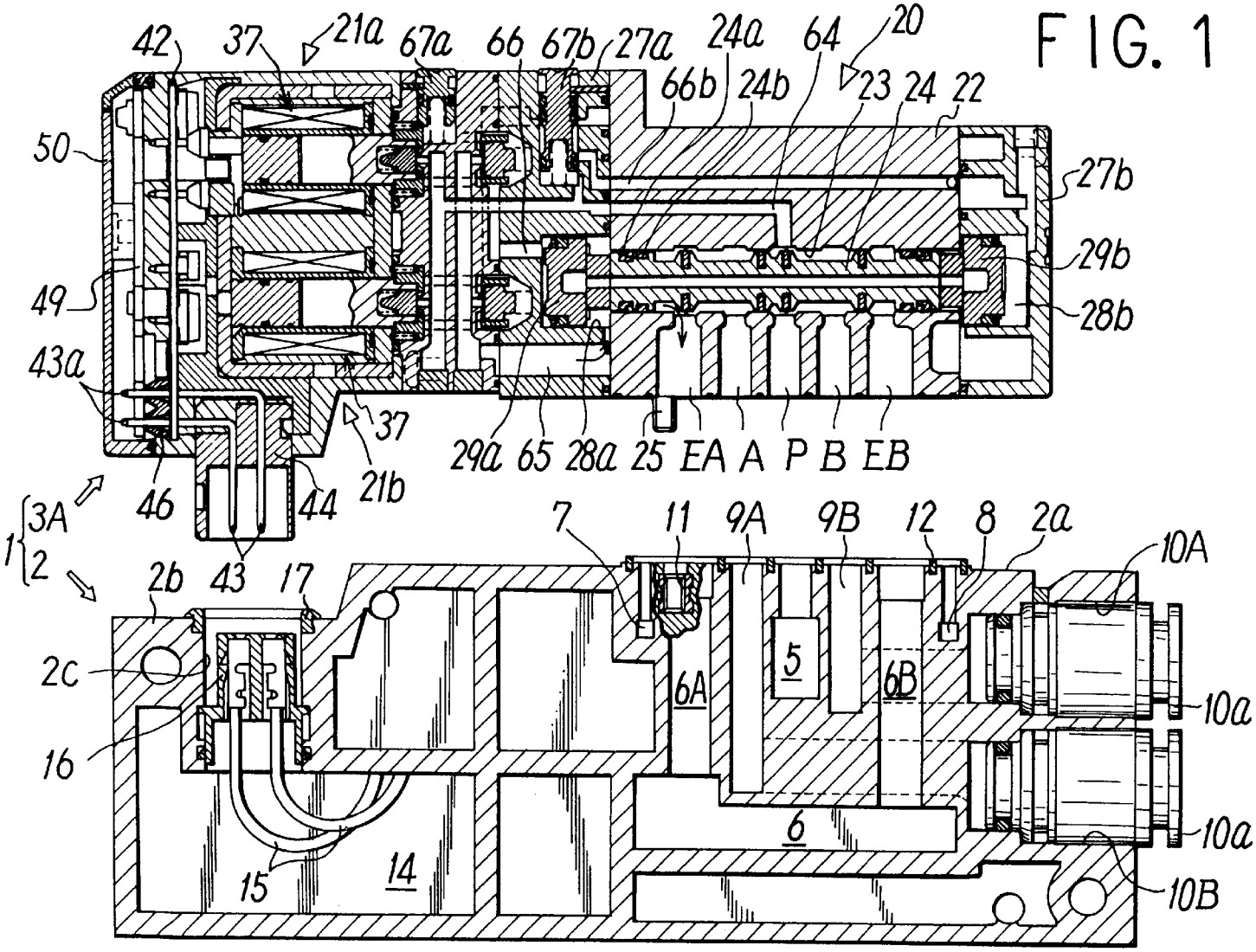
FIG. 1 is a vertical disassembled sectional view showing a first embodiment of this invention.

FIG. 1 shows a first embodiment, disassembled, of a sealed transfer valve assembly according to this invention. A sealed transfer valve assembly 1 is composed of a divided manifold 2 for each transfer valve and a solenoid-operated pilot transfer valve 3A mounted on a valve mounting surface 2*a* of manifold 2.

Manifold 2 comprises a supply channel 5 and an ejection channel 6 for a pressure fluid formed in the manifold connection direction (perpendicular to the plane of the drawing), and an external pilot supply channel 7 and external pilot ejection channel 8 used to introduce a pilot fluid from the exterior. Supply channel 5, pilot supply channel 7, and pilot ejection channel 8 are all opened to valve mounting surface 2*a*, while ejection channel 6 opens to valve mounting surface 2*a* at two positions through channels 6A and 6B.

Output channels 9A and 9B for a pressure fluid communicate with openings in valve mounting surface 2*a* and with output ports 10A and 10B on the front surface of manifold 2. A quick pipe joint 10*a* used to connect tubes is attached to output ports 10A and 10B.

A number of nuts 11 (only one is shown) used to mount a transfer valve 3A using screw 25 and gasket 12 surrounding the opening of each of the channels are provided in valve mounting surface 2*a* of manifold 2.

In addition, a low stage portion 2*b* below valve mounting 2*a* is formed at the rear end of the surface, and a depression 2*c* is formed in the low stage portion 2*b*, with a supply connector 16 provided in depression 2*c*. One of a number of supply lines 15 inserted into a wiring passage 14 passing through manifold 2 in its connection direction is connected to supply connector 16 so as to connect to a solenoid in transfer valve 3A, mounted on manifold 2; and a frame-like sealing article 17 is provided in the opening edge of depression 2*c* to seal the connection between supply connector 16 and receiving connector 44 in transfer valve 3A.

Transfer valve 3A is of a double-pilot type, in which a main valve 20, switching channels for an operating fluid, is operated by two solenoid-operated pilot valves 21*a* and 21*b*, mounted together at one end of a valve body 22 in main valve 20.

The valve body 22 of the main valve 20 comprises a supply port P, output ports A and B, and ejection ports EA and EB, all used for a pressure fluid opening to the bottom surface (on which manifold base 2 is installed); a valve hole 23 into which these ports open; a spool valve member 24 inserted into valve hole 23; and a number of set screws 25 used to mount the transfer valve on manifold 2.

A first plate 27*a* and a pilot valve body 32 are mounted on one side of valve body 22, while a second plate 27*b* is mounted on the other side in an air-tight manner, using appropriate means such as set screws. In addition, a first piston 29*a* is inserted so as to permit sliding in an air-tight manner into a first piston chamber 28*a* formed in first plate 27*a*, while a second piston 29*b* is inserted so as to permit sliding in an air-tight manner into a second piston chamber 28*b* formed in second plate 27*b* and having the same diameter as the first piston chamber.

Figure 2:
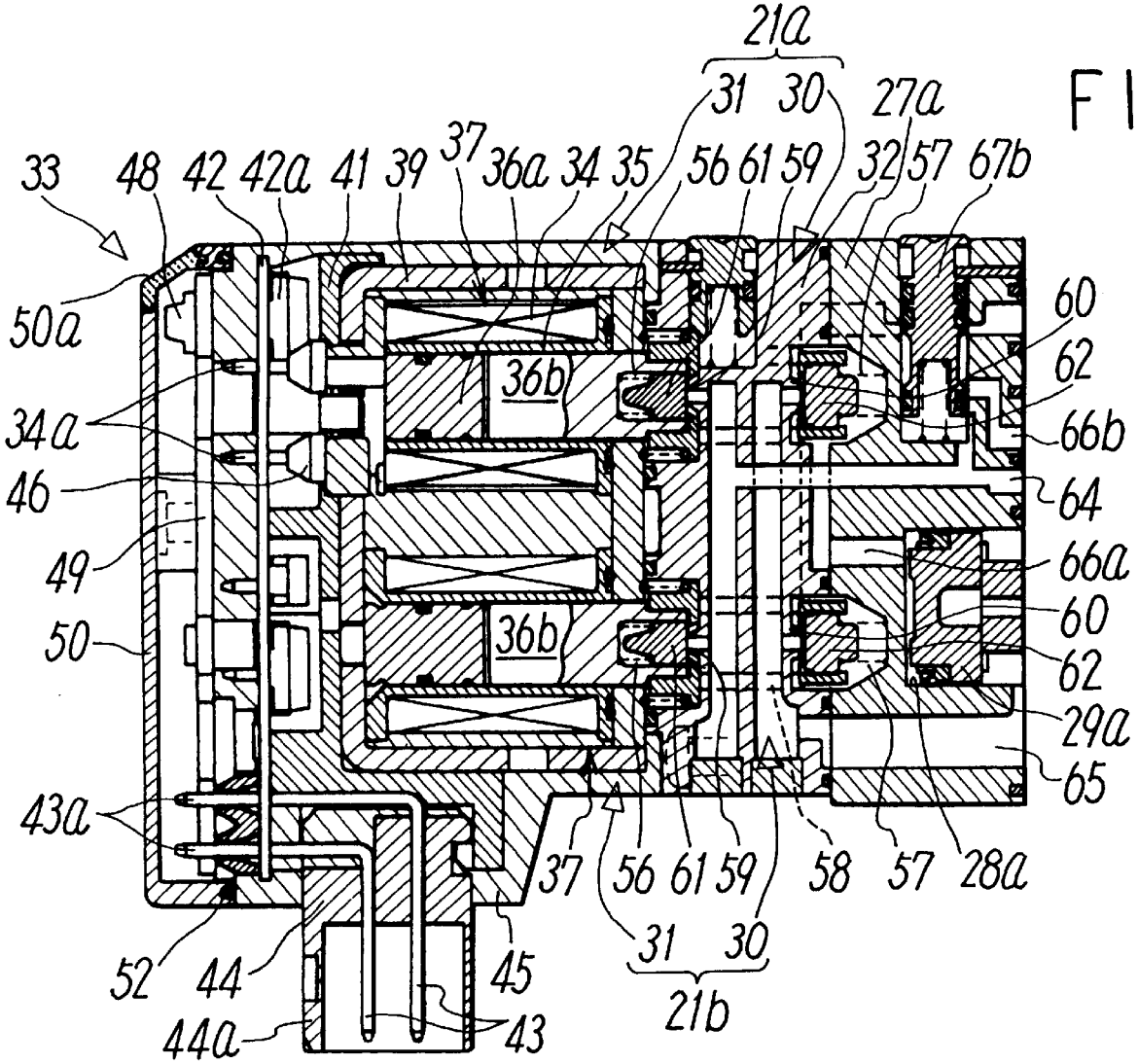
FIG. 2 is an enlarged sectional view showing an integral part of a transfer valve.

Pilot valves 21*a* and 21*b* each consist of a valve opening and closing section 30 that switches the channels for a pilot fluid, and a solenoid 31 that operates the valve opening and closing section 30, as shown in FIG. 2. The two valve opening and closing sections 30, 30 in both pilot valves 21*a* and 21*b* are integrally assembled into pilot valve body 32, and the two solenoids 31, 31 are integrally embedded in sealing synthetic resin 45, to constitute a solenoid section 33.

The configuration of solenoid section 33 and solenoid 31 is described in greater detail. In mold solenoid 31, a coil assembly 37 having bobbin 35 around which coil 34 is wound, a fixed-iron core 36*a* and a movable-iron core 36*b* mounted at one end of the center hole of bobbin 35, and coil terminals 34*a*, 34*a* shaped like a pair of pins and leading to coil 34, are accommodated inside a magnetic frame 39, so that solenoids 31, 31 in the two pilot valves 21*a* and 21*b* share the single magnetic frame 39. That is, the two coil assemblies 37, 37 in both pilot valves 21*a* and 21*b* are accommodated in parallel in rectangular magnetic frame 39 to integrate the two solenoids 31, 31.

In addition, in solenoid section 33, solenoids 31, 31, the receiving connector 44 containing within a cylindrical housing 44*a* four pin-like receiving terminals 43 in "L" shape, and a wiring board 42 having printed wiring for transmitting power between receiving terminals 43 and coil terminal 34a, are integrally sealed into synthetic resin 45. On wiring board 42, the solenoids and connector are mounted on the magnetic frame 39 via a mounting plate 41 consisting of a non-magnetic substance, and electronics 42*a*, such as Zener diodes, are mounted on wiring board 42.

Projecting from the bottom surface of solenoid section 33 toward valve mounting surface 2*a*, receiving connector 44 is fitted in depression 2*c* to connect to supply connector 16. The rear end 43*a* of each receiving terminal 43 projects toward the rear surface of solenoid section 33, and rubber caps 46 are fitted on the projecting sections.

Figure 3:
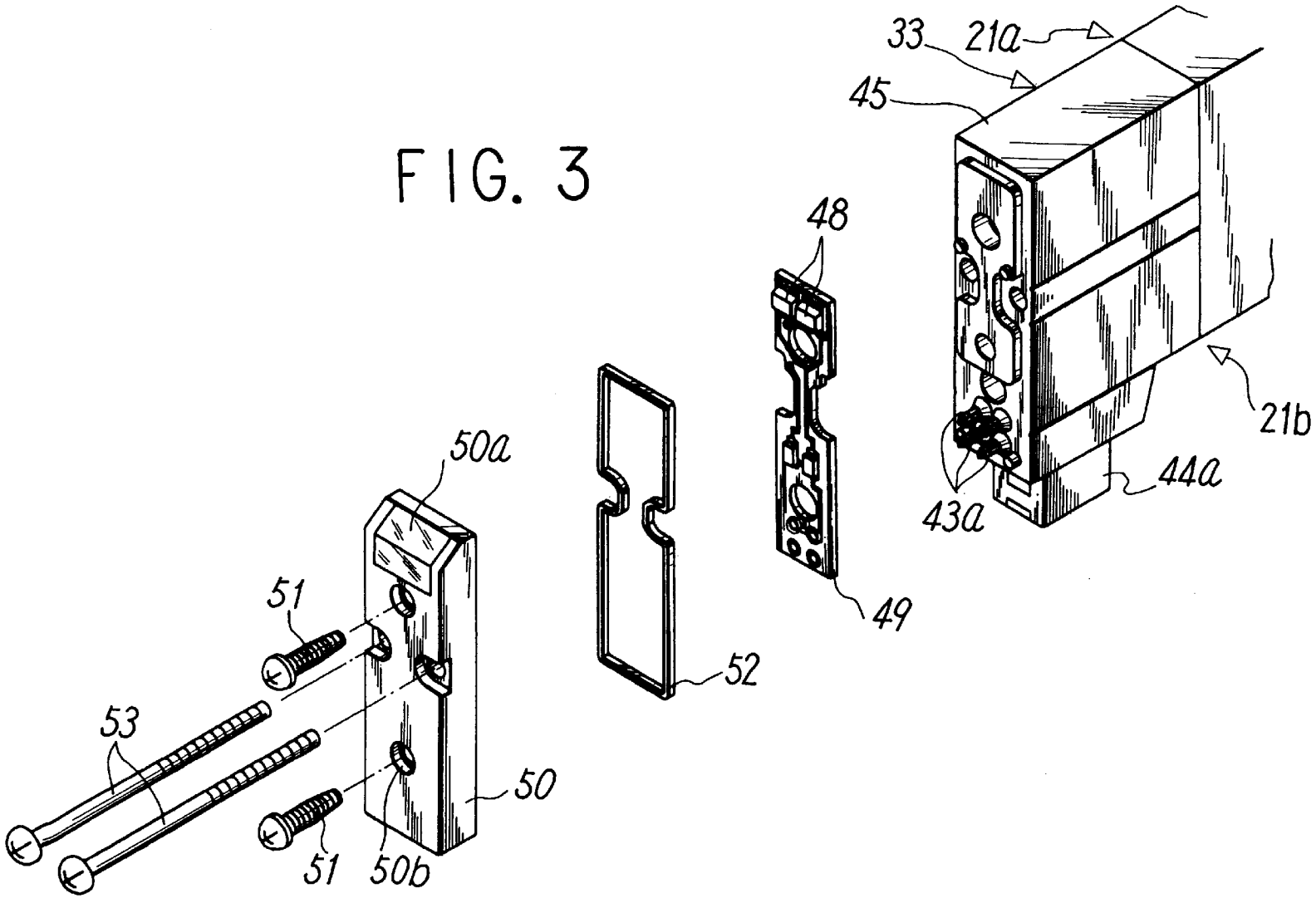
FIG. 3 is an exploded perspective view showing an integral part of the transfer valve.

As shown in FIG. 3, a lamp circuit board 49 and a cover 50 forming an air-tight seal of the lamp circuit board are mounted on the rear surface of solenoid section 33. Lamp circuit board 49 has two power supply indicator lamps 48 corresponding to pilot valves 21*a* and 21*b*, connection holes in which the rear ends 43*a* of receiving terminals 43 are fitted, and printed wiring for connecting receiving terminals 43 and lamp 48. In addition, cover 50 has a transparent portion 50*a* at a position opposite to lamp 48 and is fixed to solenoid section 33 via rectangular gasket 52 using screws 51. Ideally, a sealing article is also provided in mounting hole 50*b*, in which the head of screw 51 is fitted.

Thus, solenoid portion 33 on which lamp circuit 49 and lamp cover 50 are mounted is mounted on pilot valve body 32 in an air-tight manner using set screws 53.

Solenoid 31, lamp 48, lamp circuit board 49, and the connection between receiving terminals 43 and the lamp circuit board 4*a* in pilot valves 21*a* and 21*b* are completely sealed by synthetic resin 45 and lamp cover 50, and prevented from exposure to outside air. Even in high-humidity environments, transfer valve assembly 1 operates protected from open circuits resulting from leakage or corrosion.

A pilot supply valve chamber 56 and a pilot output valve chamber 57 are formed opposite movable-iron cores 36*b* in pilot valves 21*a* and 21*b*, respectively, and communicate through penetrating channels 58 formed through pilot valve body 32. In addition, pilot supply valve seat 59 and pilot ejection valve seat 60 are formed in these valve chambers.

A pilot supply valve disc 61, which opens and closes pilot supply valve seat 59, and a pilot ejection valve disc 62, which opens and closes pilot ejection valve seat 60, are compelled by valve springs in the direction in which they close the corresponding valve seats, and are connected through a bar-like member (not shown) loosely inserted into penetrating channel 58. These valve discs are associated so as to cause the pilot ejection valve disc 62 to close pilot ejection valve seat 60 when pilot supply valve disc 61 opens pilot supply valve seats 59, and while causing pilot ejection valve disc 62 to open pilot ejection valve seat 60 when the pilot supply valve disc 61 closes pilot supply valve seat 59.

In addition, when power to coil 34 is turned off, the compelling force of a return spring for movable-iron core 36*b* causes pilot supply valve disc 61 to close pilot supply valve seat 59.

The pilot supply valve seat 59 communicates with supply port P in main valve 20 through a pilot supply passage 64 formed in pilot valve body 32, first plate 27*a*, and valve body 22. In addition, pilot ejection valve seat 60 communicates with the chamber between first piston 29*a* and valve hole 23 through a pilot ejection passage 65 formed in pilot valve body 32 and first plate 27*a*, and with ejection port EA via the gap between valve hole 23 and a check seal 24*a* and wear ring 24*b* fitted in valve disc 24.

When the ejection air pressure of a pilot fluid exceeds the air pressure of ejection port EA, check seal 24*a* reduces the lip diameter to permit ejection of pilot fluid, and otherwise increases the lip diameter to shut off communications with ejection port EA.

Pilot output valve chamber 57 on the side of first pilot valve 21*a* communicates with first piston chamber 28*a* through pilot output passage 66*a*. Pilot output valve chamber 57 on the side of second pilot valve 21*b* communicates with second piston chamber 28*b* through pilot output passage 66*b*.

Reference numbers 67*a* and 67*b* in FIG. 1 indicate manually operated items that are pressed to supply pilot fluid to first piston chamber 28*a* and second piston chamber 28*b* when service interruption prevents the solenoid 31 from driving valve disc 24.

Transfer valve assembly 1 in the above configuration is assembled by placing transfer valve 3A on valve mounting surface 2*a* of manifold 2 and screwing screw 25 in the nut. In this case, the receiving connector 44 is fitted in depression 2*c* to connect to supply connector 16, the sealing article 17 is pressed against the outer circumference of housing 44*a* for receiving connector 44 and the outer surface of synthetic resin 45 in solenoid section 33 to form an air-tight seal against outside air for the connection between connectors 44 and 16.

In transfer valve assembly 1, when power is supplied to coil 34 in first pilot valve 21*a*, pilot fluid is supplied to first piston chamber 28*a*, moving valve disc 24 to the right in the figure and allowing supply port P to communicate with output port A, and output port B to communicate with ejection port EB.

If power to first pilot valve 21*a* is turned off and power is supplied to coil 34 in second pilot valve 21*b*, pilot air in first piston chamber 28*a* is ejected to the exterior, while pilot fluid is supplied to second piston chamber 28*b*, moving valve disc 24 to the left in the figure and allowing supply port P to communicate with output port B, and output port A to communicate with ejection port EA.

In this case, power supply to coil 34 can be visually checked from the exterior, since the lighting of lamps 48 serves as an indicator.

Although transfer valve 3A is of an internal pilot type in which a pilot fluid branches from supply port P, an external pilot transfer valve that introduces pilot fluid from an external source can also be used. The external pilot transfer valve differs from the internal pilot transfer valve in that pilot supply passage 64 is omitted. In its place, another pilot supply channel is formed to communicate with external pilot supply channel 7 in manifold 2.

Figure 4:
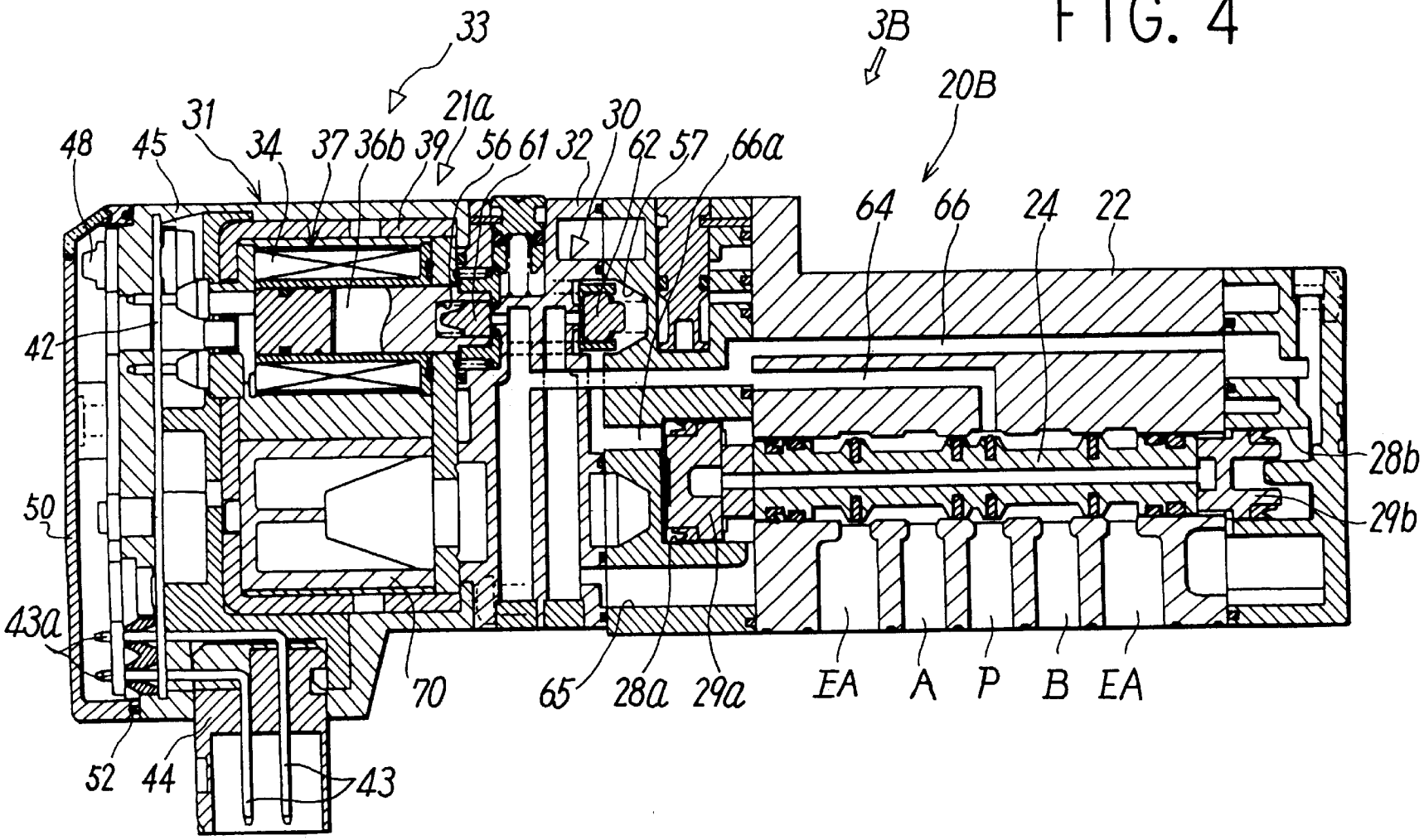
FIG. 4 is a vertical sectional view of a transfer valve according to a second embodiment.

FIG. 4 shows a second embodiment of the transfer valve in the sealed transfer valve assembly according to this invention. Transfer valve 3B is a single-pilot type having a single-pilot valve 21*a*, shaped similarly to transfer valve 3A, using as many parts as possible in common with transfer valve 3A.

Main valve 20B in transfer valve 3B has substantially the same configuration as main valve 20 in the first embodiment, except that second piston chamber 28*b* and second piston 29*b* have smaller diameters than first piston chamber 28*a* and second piston 29*a*, and that second piston chamber 28*b* communicates directly with pilot supply passage 64 through pilot output passage 66. Thus, analogous components in the figure bear the same reference numbers. Their description is omitted.

In addition, one valve opening and closing section 30 is integrated into pilot valve body 32, and one solenoid 31 and one dummy member 70 are integrated into solenoid section 33. That is, in solenoid section 33, one coil assembly 37 and dummy member 70 having substantially the same shape and size as coil assembly 37 are assembled into magnetic frame 39 of the same configuration as in the first embodiment, and this assembly is sealed into synthetic resin 45 with wiring board 42 and receiving connector 44. The other configuration is substantially the same as in the first embodiment.

Thus, except for dummy member 70, this embodiment uses the same parts as the first embodiment, reducing the number of different parts used.

According to the second embodiment, a pilot fluid is allowed to act persistently on small-diameter second piston 29*b* through pilot output passage 66, and pilot valve 21*a* is turned on and off to supply and eject a pilot fluid to and from large-diameter first piston 29*a* in order to switch valve member 24 in main valve 20B.

Although transfer valves 3A and 3B according to these embodiments both have five ports, the transfer valve according to this invention may also be of a four-port type having two output ports and one ejection port, or a three-port type having one supply port, one output port, and one ejection port.

If the transfer valve is of a four- or three-port type, the manifold base must have a number of channels and openings matching the number of ports in this transfer valve.

Figure 5:
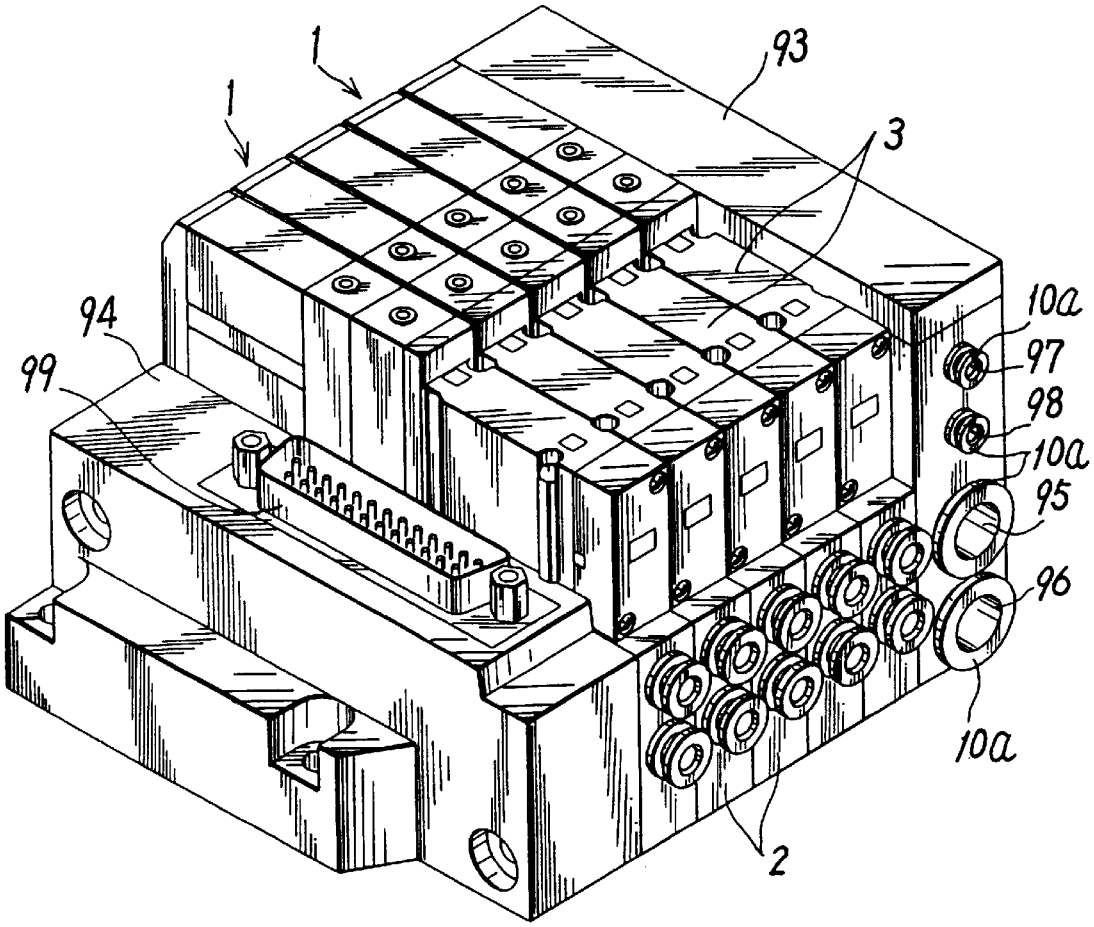
FIG. 5 is a perspective view showing an example of an operational phase of a transfer assembly of this invention.

FIG. 5 shows an example of an operational phase of the transfer valve assembly according to this invention. In this example, five transfer valve assemblies 1, piping block 93 having a supply port 95 and ejection port 96, and wiring block 94 having multi-pole connector 99 for electrical connections, are integrally connected with the appropriate means, such as connection bolts. A pressure fluid such as compressed air is collectively supplied to the transfer valve assemblies 1 through piping block 93, while power is collectively supplied by wiring block 93. In FIG. 5, reference number 97 denotes an external pilot supply port, 98 is an external pilot ejection port, and 10 is a pipe joint.

What is claimed is:

1. A sealed transfer valve assembly configured to couple a solenoid-operated pilot transfer valve, in which a main valve for switching channels for an operating fluid is operated by at least one solenoid-operated pilot valve mounted at one end of the main valve, to a manifold that supplies operating fluid and power to the transfer valve, wherein:

said manifold has a supply connector to which a receiving connector provided in the transfer valve is connected, on the valve mounting surface of which said transfer valve is mounted, wherein:

said transfer valve has a solenoid section having a solenoid in said pilot valve and said receiving connector supplying power to the solenoid that are integrally sealed into a synthetic resin, the solenoid section including a lamp circuit board mounted on an outer surface of the solenoid section, said lamp circuit board receiving power from said receiving connector and having power supply indicator lamps corresponding to the pilot valve, the solenoid section including a cover mounted on an outer surface thereof via a sealing article in an air-tight manner and covering the lamp circuit board, and wherein:

a sealing article is provided in either said manifold or said transfer valve to connect said supply connector and said receiving connector together in an air-tight manner;

the solenoid section includes the solenoid having a coil terminal, the receiving connector having a receiving terminal, and a wiring board having electronics and connecting the coil terminal to the receiving terminal;

the solenoid, the receiving connector, and the wiring board are integrally sealed in the synthetic resin; and the indicator lamps are mounted on the lamp circuit board apart from the wiring board and are not sealed in the synthetic resin.

2. A transfer valve assembly according to claim 1, wherein said receiving connector in said transfer valve has a cylindrical housing projecting from said solenoid section to the exterior and a number of pin-like receiving terminals accommodated in the housing, wherein said receiving connector in said manifold has a number of supply terminals provided in a depression in which said housing is fitted, so that the supply terminals contact said receiving terminals, and wherein said sealing article is provided at the opening edge of said depression to form an air-tight seal against the outer surface of said solenoid section and outer circumferential surface of the housing.

3. A transfer valve assembly according to claim 2, wherein the rear end of each receiving terminal in said transfer valve projects toward the rear surface of the solenoid section, wherein the lamp circuit board mounted on the rear surface has connection holes in which the rear ends of the receiving terminals are fitted and printed wiring for connecting the receiving terminals and said lamps, and wherein said cover has a transparent portion over, at minimum, those positions corresponding to the lamps.

4. A transfer valve assembly according to any of claims 1 to 3, wherein said transfer valve is of a double-pilot type having two pilot valves, and two solenoids in the two pilot valves are integrally sealed in said solenoid section of the transfer valve.

5. A transfer valve assembly according to any of claims 1 to 3, wherein said transfer valve is of a single-pilot type having one pilot valve, and one solenoid and one dummy member having substantially the same shape and size as the solenoid are integrally sealed in said solenoid section of the transfer valve.

6. A sealed transfer valve assembly configured to couple a solenoid-operated pilot transfer valve, in which a main valve for switching channels for an operating fluid is operated by at least one solenoid-operated pilot valve mounted at one end of the main valve, to a manifold that supplies operating fluid and power to the transfer valve, wherein:

said manifold has a supply connector to which a receiving connector provided in the transfer valve is connected, on the valve mounting surface of which said transfer valve is mounted;

said transfer valve has a solenoid section having a solenoid in said pilot valve and said receiving connector supplying power to the solenoid that are integrally sealed into a synthetic resin, the solenoid section including a lamp circuit board mounted on an outer surface of the solenoid section, said lamp circuit board receiving power from said receiving connector and having power supply indicator lamps corresponding to the pilot valve, the solenoid section including a cover mounted on an outer surface thereof via a first sealing article in an air-tight manner and covering the lamp circuit board;

a second sealing article is provided in either said manifold of said transfer valve to connect said supply connector and said receiving connector together in an air-tight manner;

the solenoid section includes the solenoid having a coil terminal, the receiving connector having a receiving terminal, and a wiring board having electronics and connecting the coil terminal to the receiving terminal;

the solenoid, the receiving connector, and the wiring board are integrally sealed in the synthetic resin; and the indicator lamps are mounted on the lamp circuit board apart from the wiring board and are not sealed in the synthetic resin.

7. A sealed transfer valve assembly configured to couple a solenoid-operated pilot transfer valve, in which a main valve for switching channels for an operating fluid is operated by at least one solenoid-operated pilot valve mounted at one end of the main valve, to a manifold that supplies operating fluid and power to the transfer valve, wherein:

manifold has a supply connector to which a receiving connector provided in the transfer valve is connected, on the valve mounting surface of which said transfer valve is mounted;

said transfer valve has a solenoid section having a solenoid in said pilot valve and said receiving connector supplying power to the solenoid that are integrally sealed into a synthetic resin, the solenoid section including a lamp circuit board mounted on an outer surface of the solenoid section, said lamp circuit board receiving power from said receiving connector and having power supply indicator lamps corresponding to the pilot valve, the solenoid section including a cover mounted on an outer surface thereof via a first sealing article in an air-tight manner and covering the lamp circuit board;

a second sealing article is provided in either said manifold of said transfer valve to connect said supply connector and said receiving connector together in an air-tight manner;

said receiving connector in said transfer valve has a cylindrical housing projecting from said solenoid section to the exterior and a number of pin-like receiving terminals accommodated in the housing;

said receiving connector in said manifold has a number of supply terminals provided in a depression in which said housing is fitted, so that the supply terminals contact said receiving terminals; and said second sealing article is provided at the opening edge of said depression to form an air-tight seal against the outer surface of said solenoid section and outer circumferential surface of the housing.

8. A sealed transfer valve assembly configured to couple a solenoid-operated pilot transfer valve, in which a main valve for switching channels for an operating fluid is operated by at least one solenoid-operated pilot valve mounted at one end of the main valve, to a manifold that supplies operating fluid and power to the transfer valve, wherein:

said manifold has a supply connector to which a receiving connector provided in the transfer valve is connected, on the valve mounting surface of which said transfer valve is mounted;

said transfer valve has a solenoid section having a solenoid in said pilot valve and said receiving connector supplying power to the solenoid that are integrally sealed into a synthetic resin, the solenoid section including a lamp circuit board mounted on an outer surface of the solenoid section, said lamp circuit board receiving power from said receiving connector and having power supply indicator lamps corresponding to the pilot valve, the solenoid section including a cover mounted on an outer surface thereof via a sealing article in an air-tight manner and covering the lamp circuit board;

a sealing article is provided in either said manifold of said transfer valve to connect said supply connector and said receiving connector together in an air-tight manner;

the solenoid section includes the solenoid having a coil terminal, the receiving connector having a receiving terminal, and a wiring board having electronics and connecting the coil terminal to the receiving terminal;

the solenoid, the receiving connector, and the wiring board are integrally sealed in the synthetic resin; and the indicator lamps are mounted on the lamp circuit board apart from the wiring board and are not sealed in the synthetic resin.

9. A transfer valve assembly according to claim 8, wherein said receiving connector in said transfer valve has a cylindrical housing projecting from said solenoid section to the exterior and a number of pin-like receiving terminals accommodated in the housing, wherein said receiving connector in said manifold has a number of supply terminals provided in a depression in which said housing is fitted, so that the supply terminals contact said receiving terminals, and wherein said sealing article is provided at the opening edge of said depression to form an air-tight seal against the outer surface of said solenoid section and outer circumferential surface of the housing.

10. A transfer valve assembly according to claim 8, wherein each receiving terminal in said transfer valve has a rear end projecting toward a rear surface of the solenoid section, wherein the lamp circuit board mounted on the rear surface has connection holes in which the rear ends of the receiving terminals are fitted and printed wiring for connecting the receiving terminals and said lamps, and wherein said cover has a transparent portion over, at minimum, positions corresponding to the lamps.

11. A transfer valve assembly according to claim 8, wherein said transfer valve is of a double-pilot configuration having two pilot valves, and two solenoids in the two pilot valves are integrally sealed in said solenoid section of the transfer valve.

12. A transfer valve assembly according to claim 8, wherein said transfer valve is of a single-pilot configuration having one pilot valve, and one solenoid and one dummy member having substantially the same shape and size as the solenoid are integrally sealed in said solenoid section of the transfer valve.

* * * * *